United States Patent [19]

Satake

[11] 4,426,005

[45] Jan. 17, 1984

[54] DEVICE FOR PREVENTING SCATTERING OF PARTICLES FOR COLOR SORTING APPARATUS

[75] Inventor: Toshihiko Satake, Higashi-Hiroshima, Japan

[73] Assignee: Satake Engineering Co., Ltd., Tokyo, Japan

[21] Appl. No.: 283,817

[22] Filed: Jul. 16, 1981

[30] Foreign Application Priority Data

Aug. 6, 1980 [JP] Japan ..... 55-108493
Oct. 9, 1980 [JP] Japan ..... 55-141243

[51] Int. Cl.[3] ..... B07C 5/342

[52] U.S. Cl. ..... 209/581; 209/639; 209/643

[58] Field of Search ..... 209/576, 580, 581, 582, 209/587, 908,639, 643, 555, 557; 250/223 R, 222 R, 431, 239, 215, 222.1, 222.2

[56] References Cited

U.S. PATENT DOCUMENTS

| | | | |
|---|---|---|---|
| 3,750,881 | 8/1973 | Husome et al. | 209/639 X |
| 3,914,601 | 10/1975 | Hoover et al. | 209/587 X |
| 4,057,146 | 11/1977 | Costaneda et al. | 209/581 |
| 4,074,808 | 2/1978 | Gillespie et al. | 209/587 |
| 4,096,949 | 6/1978 | Hoover et al. | 209/581 |
| 4,356,921 | 11/1982 | Fraenkel | 250/223 R |
| 4,367,817 | 1/1983 | Satake | 209/580 |

*Primary Examiner*—Robert B. Reeves
*Assistant Examiner*—Donald Hajec
*Attorney, Agent, or Firm*—Charles A. Blank

[57] ABSTRACT

A particle scattering prevention device for use in a color sorting apparatus for sorting particles according to their colors, the apparatus being of the type having a photoelectric sorting chamber accommodating a photoelectric detectors; and a blowing nozzle device adapted to operate in response to the detection output from the photoelectric detector to selectively blow air to the flow of particles to sort out the particles of the different color. The device has a scattering prevention wall disposed between the photoelectric detector and the blowing nozzle device and having a passage bore to permit the flowing particles to pass therethrough, thereby to divide the space in the photoelectric sorting chamber into a light detecting section and a blowing sorting section. Thanks to the provision of the scattering prevention wall, the dusts and particles suspended by the blown air in the blowing sorting section are prevented from coming into the light detecting section to eliminate the erroneous sorting operation attributable to the presence of dusts and particles in the light detection section. The undesirable attaching of dusts to the photoelectric detectors, as well as suspension of particles by the air, is suppressed further by means of a suction blower connected to the blowing sorting section, or means forming air curtains in parallel with and in the close proximity of transparent window plates of optic detection chambers housing the photoelectric detectors.

2 Claims, 5 Drawing Figures

DEVICE FOR PREVENTING SCATTERING OF PARTICLES FOR COLOR SORTING APPARATUS

BACKGROUND OF THE INVENTION

The present invention relates to a device for preventing scattering of particles, suitable for use in color sorting apparatus for sorting particles according to their colors.

Such a color sorting apparatus has been known as having a particle chute in which particles flow down, particle supplying means for supplying particles to the upper end of the chute, and a photoelectric sorting chamber disposed at the lower end of the chute, the photoelectric sorting chamber accommodating a photoelectric sorting device including a photoelectric detector having a light source and a light-receiving element disposed around the path of flow of the particles from the chute and a blowing nozzle device adapted to operate in response to the output from the light-receiving element of the photoelectric detector.

In this known sorting apparatus, fine powders and dusts attaching to the sorted particles are blown by the air from the blowing nozzle device and are scattered and diffused to fill the photoelectric sorting chamber. These powders and dusts suspended in the air then attach the transparent surfaces of the light source and light-receiving element of the photo-electric detector. In addition, the sorted particles are scattered to intermittently interrupt the transmitted or reflected light to be received by the light-receiving element. In consequence, the amount of light coming from the light source of the photoelectric detector is attenuated and the detection sensitivity of the light-receiving element is lowered resulting in erroneous sorting operation and, hence, deterioration in the sorting performance of the apparatus.

SUMMARY OF THE INVENTION

Accordingly, an object of the invention is to provide a device for preventing scattering of particles for use in color sorting apparatus, capable of maintaining a constant level of amount of light coming from the light source of the photoelectric detector and preserving the high detection sensitivity of the light-receiving element to ensure a high precision of sorting performed by the color sorting apparatus, thereby to overcome the above-described problems of the prior art.

To this end, according to one aspect of the invention, there is provided, in a color sorting apparatus having a particle chute in which particles to be sorted flow down, particle supplying means for supplying the particles to the upper end of the chute, and a photoelectric sorting chamber disposed at the lower end of the chute, the photoelectric sorting chamber accommodating a photoelectric sorting device including a photoelectric detector having a light source and a light-receiving element disposed around the path of flow of the particles coming down from the chute, and a blowing nozzle device adapted to operate in response to the output from the light-receiving element; a device for preventing scattering of the particles characterized by comprising a scattering prevention wall disposed between the photoelectric detector and the blowing nozzle device and having a passage bore for the particles flowing along the path of flow, the scattering prevention wall dividing the space in the photoelectric sorting chamber into an upper space constituting a light detecting section and a lower space constituting a blowing sorting section.

According to another aspect of the invention, there is provided a device for preventing scattering of particles of the type mentioned above, wherein an air discharge window is formed in a wall defining the blowing sorting section, the space in the blowing sorting section being communicated with a suction blower through the air discharge window.

According to still another aspect of the invention, there is provided a device for preventing scattering of particles of the first mentioned type, wherein the photoelectric sorting chamber includes a pair of optic detection chambers arranged to oppose to each other across the path of flow of the particles and each accommodating a photoelectric detector, the optic detection chambers facing the light detecting section through a transparent window plate, ventilation openings formed in a symmetric manner in the walls above and below the transparent window plates, and means for forming through said ventilation openings an air curtain in parallel with and in the close proximity of each transparent window plate.

By way of example only, certain illustrative embodiments of the invention will now be described with reference to the accompanying drawings.

DESCRIPTION OF THE PREFERRED EMBODIMENTS

Figure 1:
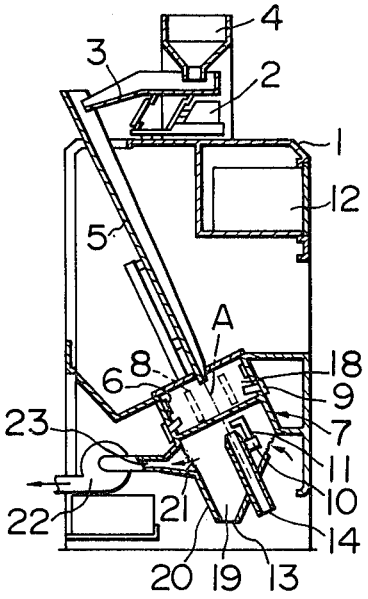
FIG. 1 is a sectional side elevational view of a color sorting apparatus incorporating a scattering prevention device constructed in accordance with an embodiment of the invention.
Figure 2:
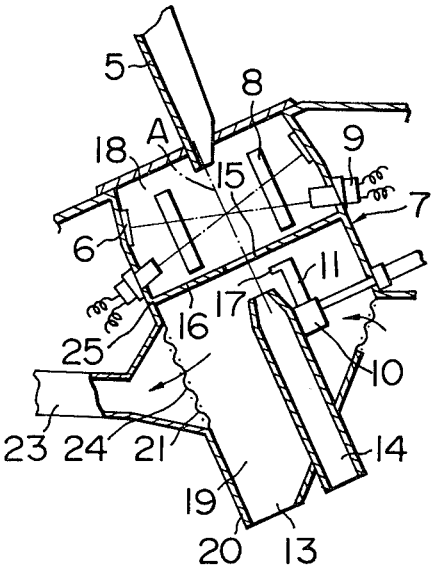
FIG. 2 is an enlarged sectional view of a photoelectric sorting chamber incorporated in the apparatus shown in FIG. 1.

Referring first to FIGS. 1 and 2, a reference numeral 1 denotes a frame of a color sorting apparatus carrying a vibrating particle feeder trough 3 having a vibrator 2. A particle supplying hopper 4 is disposed at the supplying side of the feeder trough 3, while, at the discharge side of the feeder trough 3, is disposed a downwardly extending particle chute 5 in which the particles supplied are made to flow downwardly.

A photoelectric sorting chamber 7 connected to the lower end of the particle chute 5 accommodates a photoelectric sorting device consisting of a photoelectric detector having a background 6, light source 8 and a light-receiving element 9, and a blowing nozzle device 10. The background 6, light source 8 and the light-receiving element 9 are arranged as illustrated to face the path A of flow of particles of different color coming from the chute 5. The blowing nozzle device 10 has blowing nozzle 11 which is fixed to direct its nozzle port 17 toward the path A of flow of particles. The blowing nozzle device and the photoelectric detector are electrically connected to each other through a control circuit 12. At the bottom of the photoelectric sorting chamber 7, disposed is a discharge opening 13 for particles of a different color, while, on the extension of the path A, disposed is a particle collecting cylinder 14 for collecting particles of the normal color. The particles of the normal color collected in the collecting cylinder 14 are suitably taken out of the sorting apparatus.

This sorting apparatus incorporates a device for preventing scattering of particles, constructed in accordance with an embodiment of the invention. The particle scattering prevention device includes a scattering prevention wall 16 mounted above the nozzle port 17 of the nozzle 11 in the blowing nozzle device 10. The scattering prevention wall 16 has a passage bore 15 for permitting the particles flowing along the path A to pass therethrough. The space in the photoelectric sorting chamber 7 is divided by the scattering prevention wall 16 into two parts: an upper space above the wall 16 constituting a light detecting section 18 and a lower space below the wall 16 constituting a blowing sorting section 19. An air discharge window 21 is formed in a wall 20 defining the blowing sorting section 19 and is communicated with a suction blower 22 through an air conduit 23. The air discharge window 21 is covered by an air permeable wall 24. A discharge port 25 for discharging residual particles is formed at a lower part of the surface of the scattering prevention wall 16.

Figure 3:
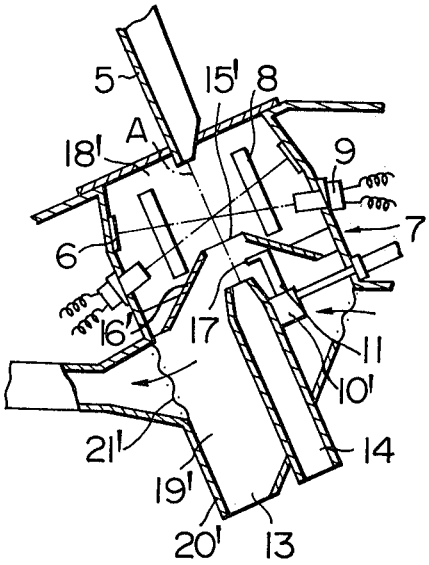
FIG. 3 is a sectional view of a modification of the photoelectric sorting chamber.

FIG. 3 shows a modification of this embodiment, in which a frusto-conical scattering prevention wall 16' having a passage bore 15' for permitting the particles flowing along the path A to pass therethrough is mounted in the area above the nozzle port 17 of the nozzle 11 in the blowing nozzle device 10. The frusto-conical scattering prevention wall 16' divides the space in the photoelectric sorting chamber 7 into two parts: the upper space above the wall 16 constituting a light detecting section 18' and a lower space below th the wall 16 constituting a blowing sorting section 19'. An air discharge window 21' formed in the wall 20' defining the blowing sorting section 19' is communicated with a suction blower.

In operation, particles of different colors are supplied from the hopper 4 and fed through the vibrating particle feeding trough 3 into the particle chute 5. In consequence, the particles flow down through the photoelectric sorting chamber 7 along a path A. The background 6 is so selected that it directs the same amount of light as that provided by the particles of the normal color to be sorted to the light-receiving element 9. Therefore, the amount of light received by the light-receiving element 9 is not changed even when there is a discontinuity of flow of the particles of the normal color. However, if the particles passing through the photoelectric detector have a different color, i.e. a color different from the normal color, the amount of transmitted or reflected light received by the light-receiving element is changed. Thus, the particles of the different color are detected through the difference of amount of light received. The detection signal is delivered to the control circuit 12 which in turn actuates the blowing nozzle device 10 to blow the particles of the different color away from the path A of flow of the particles. In this sorting operation, as stated before, the air blown from the nozzle 11 causes the dusts attaching to the particles to be released from the latter and scattered and diffused in the photoelectric sorting chamber. These dusts inconveniently attach to the transparent window plates of the photodetectors. The blown air also causes the sorted particles to be scattered to interrupt the light to be received by the light-receiving element. The dusts attaching to the transparent window plates and the particles interrupting the light seriously and adversely affect the sorting performance in the conventional sorting apparatus.

This problem, however, is completely avoided in the sorting apparatus having the particle scattering prevention device of the invention. Namely, in the sorting apparatus having the particle scattering prevention device of the invention, the light detecting section 18 (or 18') in which the above-stated problem occurs is separated from the blowing sorting section 19 (or 19') by the scattering prevention wall 16 (or 16'), so that the dusts released from the particles in the blowing sorting section 19 (or 19') and particles scattered by the air in the blowing sorting section 19 (or 19') are prevented from coming into the light detecting section 18 (or 18'). Furthermore, according to the invention, the dusts suspended by the air in the blowing sorting section 19 (or 19') are conveniently sucked and collected through the air discharge window 21 (or 21') formed in the wall 20 (or 20') defining the blowing sorting section. The suction applied through the air discharge window 21 (or 21') also acts to reduce the pressure in the blowing and sorting section 19 (or 19') to a level below the pressure in the light detecting section 18 (or 18') to effectively suppress the flowing of the dusts into the light detecting section. In addition, this reduced pressure established in the blowing sorting section serves to suck or induce the small amounts of dusts freed from the particles in the light detecting section thereby to keep the atmosphere clean in the latter. In consequence, the amount of light applied to the light-receiving element is maintained at a constant level while the normal detection sensitivity of the light receiving element is preserved to ensure a high precision of sorting, while eliminating the aforesaid erroneous sorting operation often experienced in the conventional sorting apparatus. It will be seen that the scattering prevention device of the invention greatly constributes to the improvement in the sorting performance of the sorting apparatus.

Figure 4:
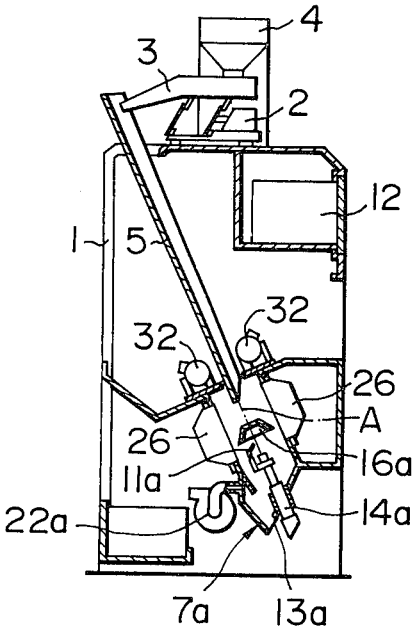
FIG. 4 is a sectional side elevational view of a color sorting apparatus incorporating a scattering prevention device constructed in accordance with another embodiment of the invention.
Figure 5:
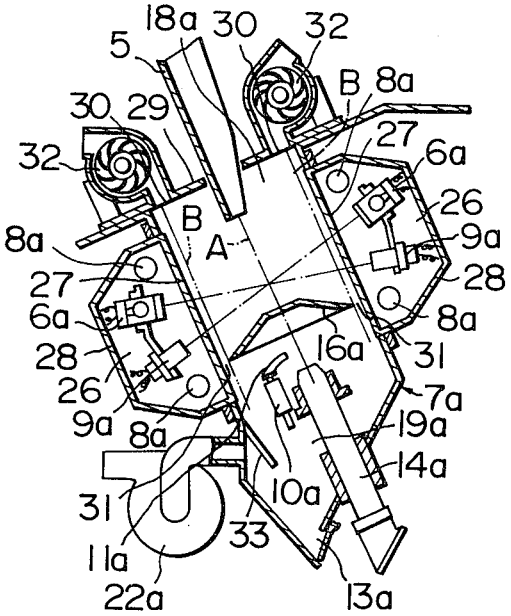
FIG. 5 is an enlarged sectional view of a photoelectric sorting chamber incorporated in the sorting apparatus shown in FIG. 4.

A second embodiment of the invention will now be described with specific reference to FIGS. 4 and 5.

Referring to these Figures, a reference numeral 1 denotes a frame of a sorting apparatus, carrying a vibrating particle feeder trough 3 having a vibrator 2. A particle supplying hopper 4 is disposed at the supplying side of the feeder trough 3, while, at the discharge side of the feeder trough 3, disposed is a downwardly extending particle chute 5 in which the particles supplied are made to flow downwardly.

A photoelectric sorting chamber **7*a* connected to the lower end of the particle chute 5 accommodates a pair of optic detection chambers 26, 26 and a blowing nozzle device 10*a*. Each optic detection chamber 26 includes light sources 8*a*, light-receiving element 9*a* and a background 6*a* arranged around the path A of linear flow of the particles of different colors coming down from the particle chute 5, while the injection nozzle device 10*a* has a nozzle 11*a* adapted to operate in response to the detection output from the light-receiving elements 9*a* through the operation of a control circuit 12 electrically connected therebetween. At the bottom of the photoelectric sorting chamber 7*a*, disposed is a discharge opening 13*a* for particles of a different color, while, on the extension of the path A, disposed is a particle collecting cylinder 14***a* for collecting particles of the normal color. The particles of the normal color collected in the collecting cylinder 14*a* are suitably taken out of the sorting apparatus.

The pair of optic detection chambers 26, 26 in the photoelectric sorting chamber 7*a* arranged to oppose to each other across the path A of flow of particles. Each detection chamber 26 has a box-like housing 28 having a front wall constituted by a transparent window plate 27. The housing 28 accommodates the aforementioned light sources 8*a*, light-receiving element 9*a* and a background 6*a* located suitably. A scattering prevention wall 16*a* is disposed between the optic detection chambers 26, 26 and the blowing nozzle 11*a*. Namely, the scattering prevention wall 16*a* divides the space in the photoelectric sorting chamber into two parts: an upper space above wall 16*a* constituting a light detecting section 18*a* and a lower space below the wall 16*a* constituting a blowing sorting section 19*a*. A suction blower 22*a* is disposed at the outside of the wall of the blowing sorting section 19*a* in such a manner as to suck the air from the latter.

In this embodiment, slit-shaped elongated ventilation openings 30, 31 are formed in the walls above and below each transparent window plate 27, i.e. in the upper wall 29 of the photoelectric sorting chamber 7*a* and in the scattering prevention wall 16*a*. A blower 32 is connected to each ventilation opening 30 formed in the upper wali 29, while the ventilation openings 31 formed in the scattering prevention wall 16*a* is communicated with the suction blower 22*a* through the blowing sorting section 19*a* defined below the scattering prevention wall 16*a*. An air deflection plate 33 is disposed in the blowing sorting section 19*a*. The ventilation openings 30, 31 and the blower 32 are arranged to form an air curtain B in parallel with and in the close proximity of each transparent window plate 27.

In operation, particles of different colors are supplied from the supplying hopper 4 and are fed by the vibrating particle feeder trough 3 to the particle chute 5. The particles then flow down along the chute and then through the photoelectric sorting chamber 7*a* obliquely downwardly along the path A. In the photoelectric sorting chamber 7*a*, the light emitted from the light source 8*a* of each optic detection chamber 26 is applied to the particles flowing along the path A, and the light transmitted or reflected by the particles is received by the light-receiving element 9*a*. The amount of light received by the light-receiving element 9*a* and the amount of light reflected by the background 6*a* are compared with each other, and the difference of the amount of light is detected as an output. This detection output is delivered to the control circuit 12 which then produces a signal for activating the blowing nozzle device 10*a* to permit the latter blow air thereby to blow the particles of the different color away from the path A.

In this sorting operation, as explained before, there is a problem that the transparent window plates 27 of the optic detection chambers 26 are contaminated by the dusts freed from the particles as a result of the blowing by the air and the particles are scattered by the air to seriously affect the amount of light received by the light-receiving element and the detection sensitivity of the latter.

This problem, however, is fairly overcome in the sorting apparatus having the scattering prevention device of this embodiment. Namely, in this sorting apparatus, as the blowers 32 and the suction blower 22*a* on the wall of the photoelectric sorting chamber 7*a* are started, streams of air are formed to flow from the slit-shaped ventilation openings 30 formed symmetrically in the wall 29 toward the slit-shaped ventilation openings 31 formed also in symmetry in the scattering prevention wall 16', in such a manner as to form air curtains B in parallel with and in the close proximity of the transparent window plates 27. These air curtains B perfectly prevent the dusts from coming into contact with the transparent window plates and continuously clean the latter. In consequence, the reduction of amount of light exchanged between the light source, light-receiving element and the back ground, as well as the deterioration in the detection sensitivity of the light-receiving element, is avoided to advantageously ensure the good photoelectric action and, hence the high precision of sorting of the particles according to their colors.

What is claimed is:

1. In a color sorting apparatus having a particle chute in which particles to be sorted flow down, particle supplying means for supplying said particles to the upper end of said chute, and a photoelectric sorting chamber disposed at the lower end of said chute, the photoelectric sorting chamber accommodating a photoelectric sorting device including a photoelectric detector having a light source and a light-receiving element disposed around the path of flow of said particles coming down from said chute, and a blowing nozzle device adapted to operate in response to the output from said sight-receiving element;

a device for preventing scattering of said particles characterized by comprising a scattering prevention wall disposed between said photoelectric detector and said blowing nozzle device and having a passage bore permitting the flowing particles to pass therethrough, said scattering prevention wall dividing the space in the photoelectric chamber into an upper space constituting a light detecting section and a lower space constituting a blowing sorting section, an air discharge window being formed in a wall defining the blowing sorting section, the space in the blowing sorting section being communicated with a suction blower through said air discharge window.

2. A device for preventing the scattering of particles as claimed in claim 1, wherein said photoelectric sorting chamber includes a pair of optic detection chambers arranged to oppose to each other across the path of flow of said particles and each accommodating a photoelectric detector, each of said optic detection chambers being facing said light detecting section through a transparent window plate, ventilation openings formed in a symmetric manner in a wall above respective transparent window plates and ventilation openings formed in a symmetric manner in a wall below respective transparent window plates, and means associated with said ventilation openings and adapted for forming air curtains in parallel with and in the close proximity of respective transparent window plates.

* * * * *

UNITED STATES PATENT AND TRADEMARK OFFICE

CERTIFICATE OF CORRECTION

PATENT NO. : 4,426,005

DATED : Jan. 17, 1984

INVENTOR(S) : Toshihiko Satake

It is certified that error appears in the above-identified patent and that said Letters Patent are hereby corrected as shown below:

Claim 1, col. 6, l. 36: delete "sight-receiving" and substitute -- light-receiving --.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*